United States Patent [19]

Beer et al.

[11] Patent Number: 4,941,436

[45] Date of Patent: Jul. 17, 1990

[54] COOLING SYSTEM FOR I.C.E. VALVE SEAT INSERTS

[75] Inventors: Michael Beer, Wimsheim; Philipp Schimko, Gesigheim; August Hofbauer, Pforzheim; Matthias Kröner, Denkendorf, all of Fed. Rep. of Germany

[73] Assignee: Dr. Ing. h.c.F. Porsche AG, Fed. Rep. of Germany

[21] Appl. No.: 400,681

[22] Filed: Aug. 30, 1989

[30] Foreign Application Priority Data

Aug. 30, 1988 [DE] Fed. Rep. of Germany ..... 3829339

[51] Int. Cl.[5] ..... F01P 3/14

[52] U.S. Cl. ..... 123/41.77; 123/41.42

[58] Field of Search ..... 123/41.76, 41.77, 188 G, 123/188 C, 41.31, 41.33, 41.34, 41.41, 41.42; 137/340

[56] References Cited

U.S. PATENT DOCUMENTS

| | | | |
|---|---|---|---|
| 3,115,125 | 12/1963 | Spencer et al. | 123/41.77 |
| 4,182,282 | 1/1980 | Pollet | 123/41.77 |

FOREIGN PATENT DOCUMENTS

| | | | |
|---|---|---|---|
| 1576727 | 6/1970 | Fed. Rep. of Germany . | |
| 3412052 | 2/1987 | Fed. Rep. of Germany . | |
| 668962 | 3/1952 | United Kingdom | 123/41.76 |
| 844119 | 8/1960 | United Kingdom | 123/41.77 |

*Primary Examiner*—Noah P. Kamen

*Attorney, Agent, or Firm*—Evenson, Wands, Edwards, Lenahan & McKeown

[57] ABSTRACT

Valve seat inserts of a four-cycle internal-combustion engine are cooled by the lubricating oil of the oil circulating system. An oil duct extending in the camshaft housing is bored in such a manner that the lubricating oil flows from the oil duct into a ring duct surrounding the valve seat inserts. By means of a projection which closes off the ring duct, a forced flow around the valve seat insert is achieved before the lubricating oil flows out of the ring duct through an opening located close to the lubricating oil inlet. From the ring duct the lubricating oil flows through a discharge pipe to the camshaft where it is sprayed on the cams.

14 Claims, 4 Drawing Sheets

COOLING SYSTEM FOR I.C.E. VALVE SEAT INSERTS

BACKGROUND AND SUMMARY OF THE INVENTION

The invention relates to a valve seat insert cooling system for an air cooled internal combustion engine.

It is known to cool the thermally highly stressed valve seat inserts of exhaust valves of an internal-combustion engine. On the basis of DE-PS 34 12 052, a valve seat insert cooling system is known in which the cooling water used for the cooling of the internal-combustion engine is used as the cooling medium for the valve seats. In this case, the cooling water flows radially into an inlet to the cooling ducts of the valve seat inserts and is discharged through an opening which is opposite the inlet. The outflow openings lead into a duct which leads directly into the intake side of the cooling water pump which supplies the internal-combustion engine with cooling water. This arrangement cannot be used when the internal-combustion engine is air-cooled.

It is known (DE-OS 15 76 727) to cool the valve seat inserts of a liquid-cooled internal-combustion engine independently of the main liquid circulating system by means of another coolant, such as lubricating oil located in a separate coolant circulating system. In this construction, the coolant first flows to the exhaust valve seat inserts and from there to the valve seat inserts of the intake valves.

Here the flow around the seat inserts is not necessarily uniform because of the guiding path of the pipes. In addition, when lubricating oil is used for the cooling of the valve seat inserts, a separate coolant circulating system with a separate pump is required.

It is therefore an object of the invention to provide a cooling system for valve seat inserts of an air-cooled internal-combustion engine. The valve seats are connected to an existing lubricating oil circulating system to achieve optimal and uniform cooling.

According to the invention, this object is achieved by providing a system wherein one feed and one discharge pipe lead into a ring duct in closely adjacent openings. The ring duct has a projection between the two openings which narrows it down considerably. An outlet opening from the discharge pipe is arranged in direct proximity of valve actuation cams in the camshaft housing.

As a result of the manner of feeding and removing the coolant, the whole coolant flow supplied to each valve seat insert flows around the valve seat insert so that the valve seat insert is almost completely encircled by the coolant inflow and outflow. Having the cooling flow directly adjacent the valve seat is of decisive importance for a maximum heat transmission and a uniform cooling. Furthermore, an existing lubricating oil circulating system is advantageously utilized for feeding and removing the coolant lubricating oil. The lubricating oil which is returned from the valve seat inserts, does not flow into the oil sump in an unutilized manner, but rather is sprayed on the cams of the camshaft. This results in a reduction of the wear in the frictional pairing of the cam and its valve and increases the useful life of both parts.

In a first preferred embodiment of the invention, the feed and discharge ducts of the coolant oil can be easily produced as vertical bores (perpendicularly to the joint face between the cylinder head and the camshaft housing).

A second preferred embodiment of the invention requires no boring operation in the cylinder head for the feed and discharge ducts, because they are constructed in one piece with a part of a cooling ring. In this way they are cast into the cylinder head. The cooling ring, surrounding the valve seat insert, is constructed of two cooling ring parts which are welded together with one another. The ring duct extending in the cooling ring is closed off so as to avoid oil leakage. This is particularly advantageous because no oil can reach the combustion space or the outlet duct. In addition, no leakage oil is discharged when the valve seat insert must be exchanged or reworked. The valve seat insert can be exchanged easily and the material for the valve seat insert may be selected arbitrarily and independently of the cooling ring.

In both embodiments, the surface of the ring duct is enlarged by at least two surrounding projections so that an optimal heat transmission takes place.

Other objects, advantages and novel features of the present invention will become apparent from the following detailed description of the invention when considered in conjunction with the accompanying drawings.

DETAILED DESCRIPTION OF THE DRAWINGS

Figure 1:
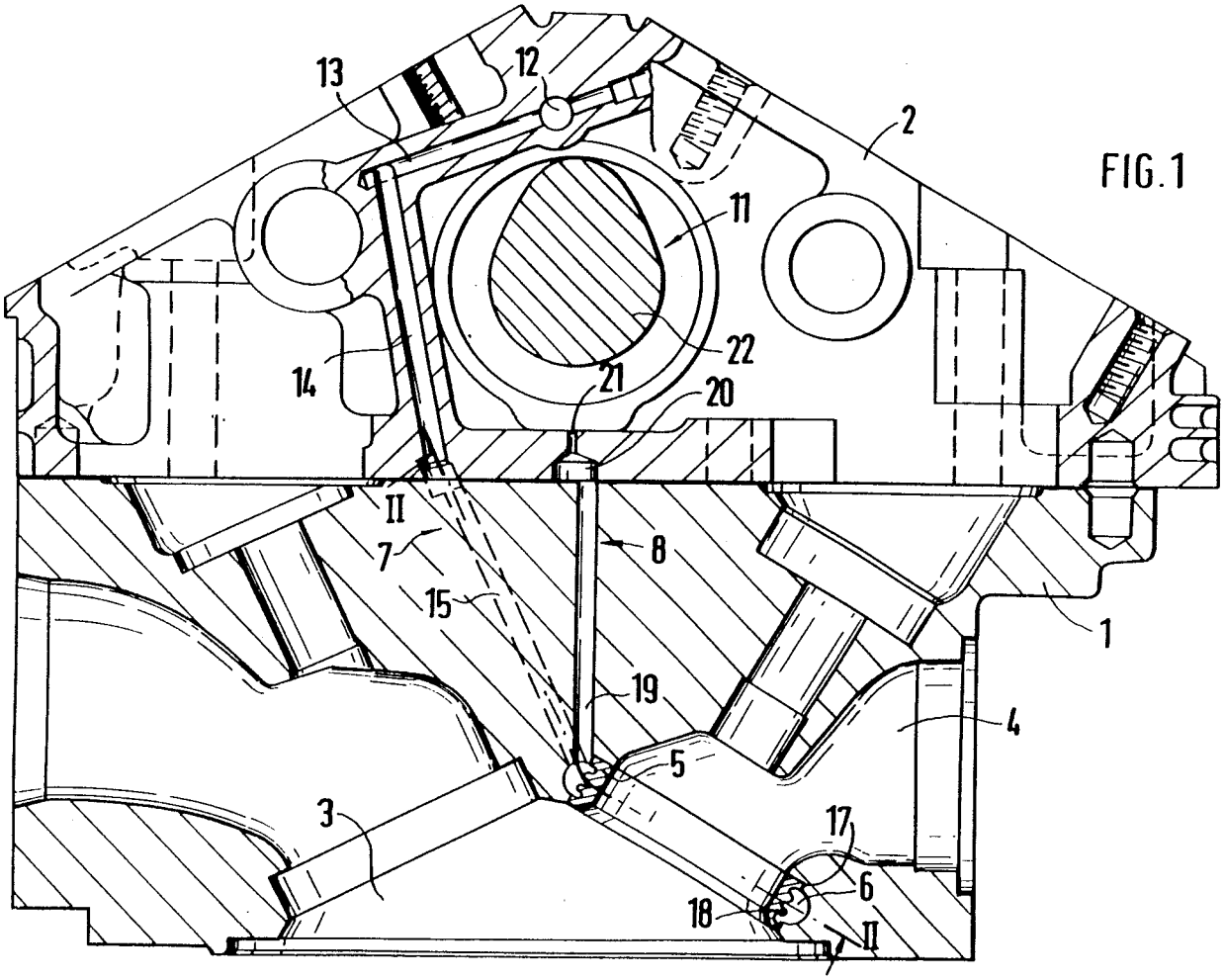
FIG. 1 is a sectional schematic view of a first preferred embodiment of the invention, arranged in a cylinder head of an air coded reciprocating piston internal combustion engine.

FIG. 1 shows a cylinder head 1 with a camshaft housing 2 of a four-cycle internal-combustion engine. The camshaft housing 2 is mounted on the cylinder head 1. For controlling the charge cycle in a combustion space 3, the cylinder head 1 has, among other things, at least one outlet or exhaust duct 4 and exhaust valve (not shown). A valve seat insert 5 is arranged in each outlet duct 4 and is surrounded by a ring duct 6. Lubricating oil, used for the lubrication of the internal-combustion engine, circulates in the ring duct 6 as a cooling medium for the valve seat 5. The ring duct 6 encircles the valve seat insert and is provided with a lubricating oil feed pipe 7 and with a discharge pipe 8 which connects to the ring duct 6 at two openings 9, 10 situated closely together.

An oil duct 12 supplies the camshaft bearings with lubricating oil and extends in parallel to at least one camshaft 11 in the camshaft housing 2. The feed pipe 7 is formed by two bores 13, 14 that extend transversely with respect to the oil duct 12 in the camshaft housing 2 and a further bore 15 in the cylinder head 1 which connects to the bore 14.

Figure 5:
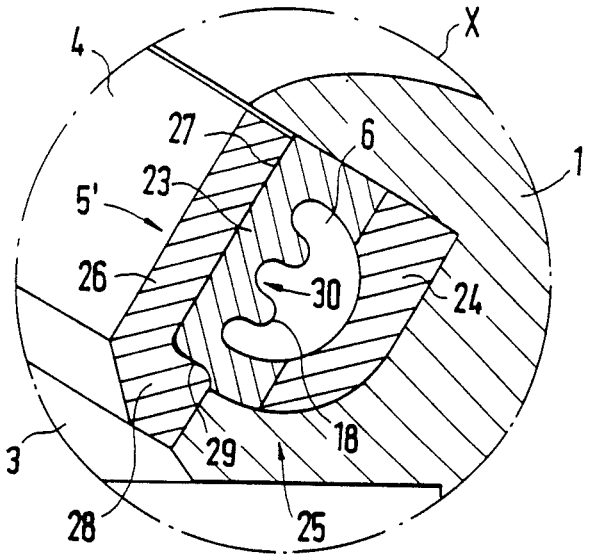
FIG. 5 is a detail X from FIG. 4.

Lubricating oil is conveyed in a pressurized manner from an oil pump through the lubricating oil circulating system of the internal-combustion engine to the oil duct 12 and from there through the feed pipe 7 into the ring duct 6. A projection 16 protrudes into the ring duct 6 to almost completely separate the opening 9 from the opening 10. Thus, only a very small part of the oil volume in feed line 7 can flow through and over the abutment directly from opening 9 to opening 10. In order to achieve an optimal heat transmission between the cooling oil and the valve seat insert 5 (5' in FIG. 5), which is heated extensively by the exhaust gases of the internal-combustion engine, the outer surface 17 of the valve seat insert 5 and the outer surface 30 of the inner cooling ring part 23 (FIG. 5) are provided with at least two surrounding projections 18.

After the flow of the oil has almost completely surrounded the valve seat insert 5, it flows through the opening 10 into the discharge pipe 8. This discharge pipe 8 is formed by a bore 19 which extends vertically towards the camshaft with respect to the joint face between the cylinder head 1 and the camshaft housing 2.

Figure 3:
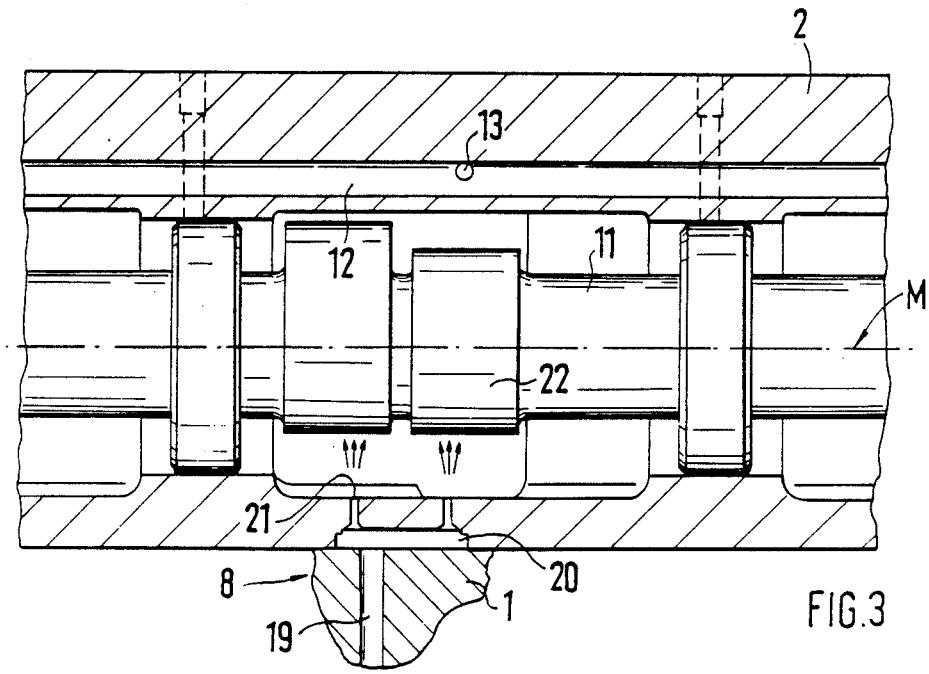
FIG. 3 is a top view of a detail of FIG. 1.

FIG. 3 shows that the discharge pipe 8 in the camshaft housing 2 is connected to a parallelepiped collecting space 20 which has at least two outlet openings 21. The distance of the outlet openings 21 with respect to one another is selected to be such that the oil emerging from the collecting space 20 is sprayed directly on the cams 22 of the camshaft 11. As a result, the wear between the cams 22 and the valves is reduced and their durability is increased.

Figure 4:
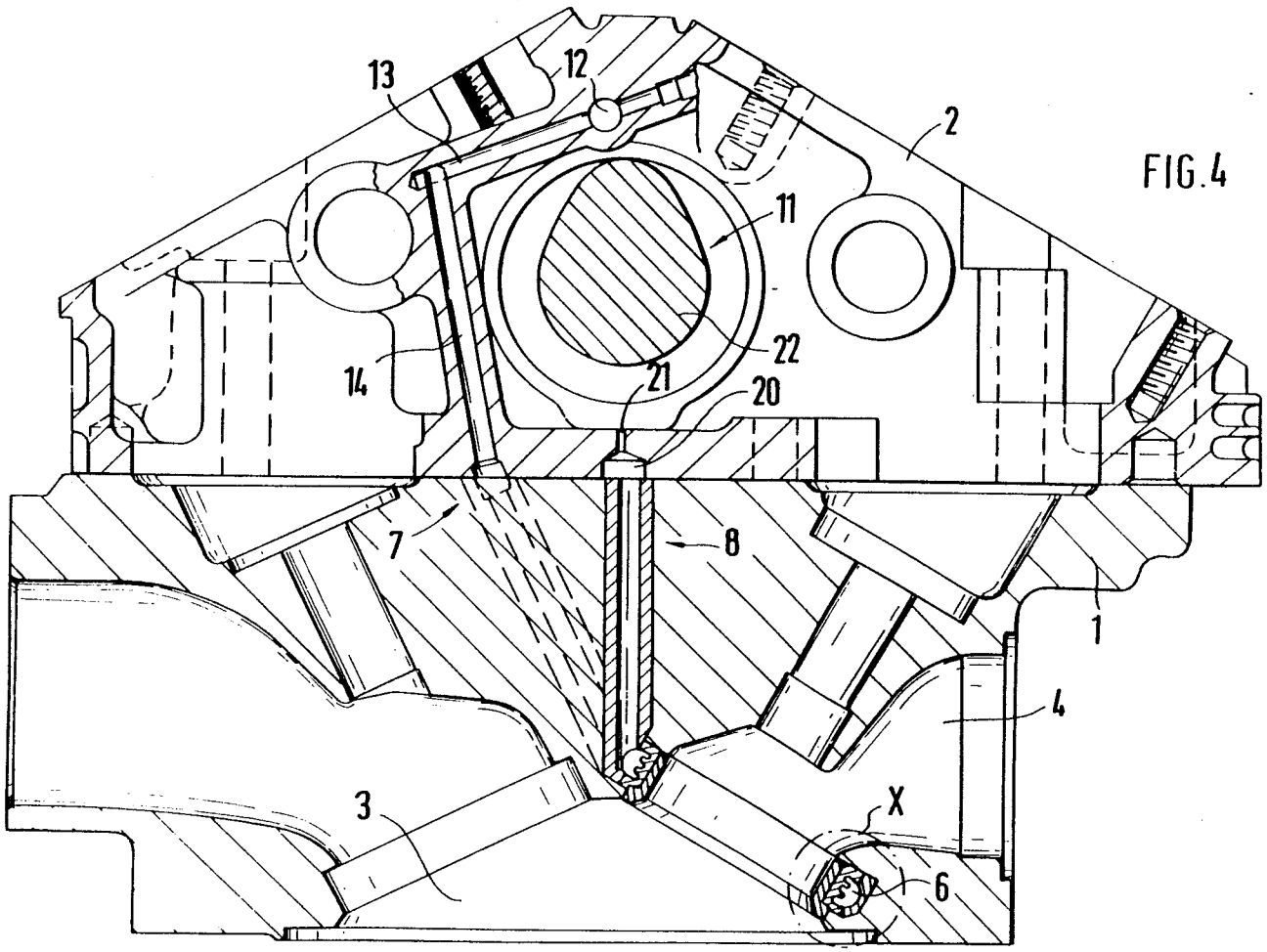
FIG. 4 is a sectional view of a second preferred embodiment of the invention, arranged in an engine cylinder head.

FIG. 4 shows a second embodiment of the invention. In this case, the oil has no direct contact with the valve seat insert 5', but instead the oil flows in a ring duct 6 which extends inside a cooling ring 25. The cooling ring 25 consists of an inner cooling ring part 23 and an outer cooling ring part 24. The valve seat ring 5' has an L-shaped cross-sectional surface and is pressed into the cooling ring 25. In this case, a leg 26 of the valve seat insert 5' is in surface contact with the interior surface 27 of the inner cooling ring part 23 to ensure a good heat transmission from the valve seat insert 5' to the cooling ring 25. Another leg 28 rests against the front face 29 of the inner cooling ring part facing the combustion space 3 and thus defines the desired pressing depth of the valve seat insert 5' into the cooling ring 25. Furthermore, in this manner, the shifting of the valve seat insert into the outlet duct 4 is prevented by the closing outlet valve 4.

Figure 2:
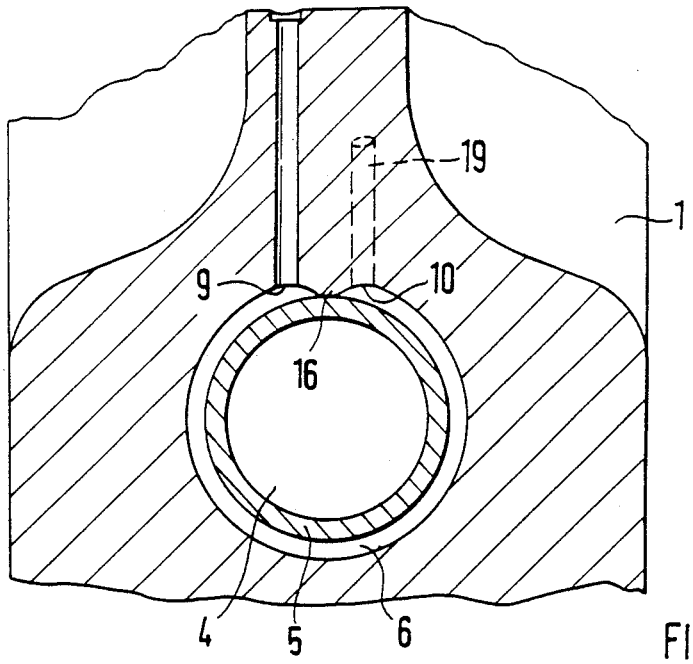
FIG. 2 is a sectional view of FIG. 1 taken along Line II—II.

The part of the feeding pipe 7 extending inside the cylinder head 1 as well as the discharge pipe 8 are constructed in one piece with the outer cooling ring part 24. After the inner and the outer cooling ring parts 23, 24 are welded together to form the cooling ring 25, this cooling ring 25 is cast into the cylinder head 1. Thus boring work in the cylinder head 1 for the coolant feeding and removal is not required. The coolant feeding inside the camshaft housing 2 and the use of the discharged coolant as a lubricant between the cams 22 and the valves takes place in the same manner as in the first embodiment of the invention. Likewise the ring duct 6 has a divider 16 (not shown) similar to FIGS. 1–3.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A cooling system for valve seat inserts arranged in a cylinder head of an air-cooled internal-combustion engine, comprising:

one ring duct respectively for the flowing-through of lubricating oil and surrounding the valve seat inserts, another oil duct which supplies bearing points of a camshaft with lubricating oil and which extends in parallel to the camshaft in a camshaft housing arranged above a cylinder head, one feed pipe which leads from the oil duct to the ring duct, and a discharge pipe which leads from the ring duct into the camshaft housing, wherein the one feed and the discharge pipe lead into each ring duct in closely adjacent openings, wherein an outlet opening of the discharge pipe in the camshaft housing is arranged in direct proximity of cams, and wherein the ring duct has a projection between the two openings which narrows it down considerably to direct flow of oil around the valve seat insert.

2. A cooling system according to claim 1, wherein the ring duct is constructed in a cooling ring which encircles the valve seat insert.

3. A cooling system according to claim 2, wherein the cooling ring consists of an inner cooling ring part and an outer cooling ring part, and wherein the outer cooling ring part contains a part of the feeding and discharge pipes which lead into the outer cooling ring part in the closely adjacent openings.

4. A cooling system according to claim 3, wherein the outer cooling ring part is constructed in one piece with the feeding and discharge pipe.

5. A cooling system according to claim 3, wherein the exterior surface of the inner cooling ring part have at least two surrounding projections.

6. A cooling system according to claim 3, wherein each valve seat insert has an L-shaped cross-section and with a leg that rests against an interior surface of the inner cooling ring part and with a leg that rests against a front face of the inner cooling ring part.

7. A cooling system according to claim 2, wherein a collecting space is assigned to each discharge pipe in a joint face between the cylinder head and the camshaft housing, this collecting space being formed in the camshaft housing and having at least two outlet openings in the direction of the camshaft.

8. A cooling system according to claim 7, wherein each outlet opening of a collecting space points to a cam of the camshaft.

9. A cooling system according to claim 2, wherein the exterior surface of the valve seat insert have at least two surrounding projections.

10. A cooling system according to claim 2, wherein nonferrous heavy metal or steel is used as the material for the cooling ring.

11. A cooling system according to claim 1, wherein each feed pipe is formed by bores extending transversely with respect to the oil duct in the camshaft housing and in a cylinder head, and wherein the discharge pipe is formed by one bore in the cylinder head, the direction of which pointing from the ring duct vertically to the longitudinal center axis (M) of the camshaft 12. A cooling system according to claim 1, wherein a collecting space is assigned to each discharge pipe in a joint face between the cylinder head and the camshaft housing, this collecting space being formed in the camshaft housing and having at least two outlet openings in the direction of the camshaft.

13. A cooling system according to claim 12, wherein each outlet opening of a collecting space points to a cam of the camshaft.

14. A cooling system according to claim 1, wherein the exterior surface of the valve seat insert have at least two surrounding projections.

* * * * *